US006109488A

United States Patent [19]

Horton

[11] Patent Number: 6,109,488

[45] Date of Patent: Aug. 29, 2000

[54] APPARATUS FOR CONDITIONING AND DISPENSING LOOSE FILL INSULATION MATERIAL

[75] Inventor: Paul H. Horton, Hollis, Okla.

[73] Assignee: Western Fibers, Inc., Hollis, Okla.

[21] Appl. No.: 09/374,441

[22] Filed: Aug. 13, 1999

[51] Int. Cl.[7] ..... B02C 17/16

[52] U.S. Cl. ..... 222/636; 222/238; 241/60; 241/195; 366/300; 366/325.2; 366/325.3; 406/137

[58] Field of Search ..... 222/333, 190, 222/636, 238, 227, 630, 367–368; 241/60, 195; 366/300, 325.2, 325.3; 406/135, 64

[56] References Cited

U.S. PATENT DOCUMENTS

| | | | |
|---|---|---|---|
| 1,413,345 | 4/1922 | Morris . | |
| 2,306,698 | 12/1942 | Heller | 23/314 |
| 2,517,903 | 8/1950 | Luhrmann | 198/220 |
| 2,550,354 | 4/1951 | Jacobsen | 91/8 |
| 2,861,294 | 11/1958 | Glaxner et al. | 18/1 |
| 3,244,408 | 4/1966 | Brownlie et al. | 259/6 |
| 3,529,870 | 9/1970 | Woten | 302/49 |
| 3,807,646 | 4/1974 | Leiter et al. | 241/60 |
| 3,870,199 | 3/1975 | Dugger et al. | 222/368 |
| 4,411,390 | 10/1983 | Woten | 406/64 |
| 4,978,252 | 12/1990 | Sperber | 406/64 |
| 5,381,837 | 1/1995 | Kurosu et al. | 222/238 |
| 5,829,649 | 11/1998 | Horton | 22/636 |

FOREIGN PATENT DOCUMENTS

| | | |
|---|---|---|
| 2099776A | 12/1982 | United Kingdom . |
| 2193478A | 2/1988 | United Kingdom . |

*Primary Examiner*—Philippe Derakshani
*Attorney, Agent, or Firm*—Dunlap, Codding & Rogers, P.C.

[57] ABSTRACT

An apparatus capable of conditioning and dispensing high volumes of loose fill insulation material includes a hopper for receiving unconditioned insulation material and for conditioning the insulation material, and an air lock for receiving the conditioned insulation material from the hopper and for discharging the insulation material. The hopper has an upper conditioning compartment and a lower conditioning compartment which are in open communication with each other. At least one upper shaft, which has a plurality of spikes extending radially therefrom in a helical pattern, is supported in the upper conditioning compartment of the hopper. A set of lower shafts including at least three shafts, each with a plurality of spikes extending radially therefrom, are supported in the lower conditioning compartment of the hopper. A drive assembly is operatively connected to the upper and lower a shafts to provide rotational movement to each of the upper and lower shafts.

11 Claims, 8 Drawing Sheets

APPARATUS FOR CONDITIONING AND DISPENSING LOOSE FILL INSULATION MATERIAL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to machines for conditioning and dispensing insulation materials.

2. Brief Description of the Related Art

Fibrous materials such as glass fiber materials, cellulose fibers, expanded mica, granulated rock wool, and granulated mineral fiber wools, have long been used to insulate walls and attics. These materials are commonly known as "loose fill" insulation material. To function most effectively, loose fill insulation materials should be placed into attics and walls in a "fluffy" condition. However, loose fill insulation material is susceptible to becoming compacted during storage and transportation.

To install the material, the insulation material is removed from the bags and placed into a machine which conditions the material by breaking up or dispersing clumps and otherwise "fluff up" the material. Thereafter, the machine blows the conditioned material into the area to be insulated. While such machines have successfully met the need for installing loose fill insulation materials at low to moderate rates, clogging problems are nevertheless encountered when attempting to increase installation rates to more than about 130 bags of material per hour.

To this end, a need exists for an apparatus which can effectively condition and dispense high volumes of loose fill insulation material. It is to such an apparatus that the present invention is directed.

BRIEF SUMMARY OF THE INVENTION

The present invention is related to an apparatus for conditioning and dispensing insulation materials at higher installation rates, therefore avoiding the disadvantages and defects in the prior art. In one aspect, the present invention relates to an apparatus for conditioning and dispensing loose fill insulation material. Broadly, the apparatus of the present invention includes a hopper for receiving unconditioned insulation material and conditioning the insulation material and an air lock for receiving the conditioned insulation material from the hopper and for discharging conditioned insulation material.

The hopper is provided with a first end, a second end, a first side, and a second side. The hopper has an upper conditioning compartment, whose length extends from the first end to the second end of the hopper, and a lower conditioning compartment, whose length is less than the length of the upper conditioning compartment. The upper and lower conditioning compartments are in open communication with each other, with the upper compartment proximate one end of the hopper via an access opening.

At least one upper shaft is supported rotatably and longitudinally in the upper conditioning compartment of the hopper. The shaft is provided with a plurality of spikes extending radially therefrom in a helical pattern which are configured to cause movement of loose fill insulation material toward the access opening of the hopper upon rotation of the shaft. The spikes of the shaft desirably have a flattened end to facilitate movement of loose fill insulation material from the upper conditioning compartment into the lower conditioning compartment.

The apparatus further includes an air lock assembly for receiving the conditioned loose fill insulation material from the lower conditioning compartment of the hopper. The air lock assembly is positioned below the lower conditioning compartment of the hopper. A partition is slidably supported in the bottom of the lower conditioning compartment of the hopper to adjust an opening between the lower conditioning compartment of the hopper and the air lock assembly whereby the flow of conditioned loose fill insulation material from the lower conditioning compartment of the hopper into the air lock assembly may be selectively controlled. The upper conditioning compartment of the apparatus of the present invention may be provided with two upper shafts supported longitudinally and mounted for rotation in the upper conditioning compartment, one of the upper shafts configured to cause movement of loose fill insulation material away from the access opening of the hopper and the other upper shaft configured to cause movement of loose fill insulation material toward the access opening of the hopper. A portion of the spikes of at least one of the upper shafts desirably have a flattened end to facilitate movement of loose fill insulation material from the upper conditioning compartment into the lower conditioning compartment.

The upper conditioning compartment of the apparatus of the present invention may also be provided with two sets of upper shafts supported in the upper conditioning compartment. The first set of upper shafts includes at least three shafts supported in a generally parallel, horizontal planar relationship so as to provide a center shaft and two outer shafts, the center shaft configured to cause movement of loose fill insulation material away from the access opening and the outer shafts configured to cause movement of loose fill insulation material toward the access opening. The second set of upper shafts includes at least two shafts supported in a generally parallel, staggered relationship with respect to the first set of upper shafts and with a portion of the shafts of the second set of upper shafts positioned above the lower conditioning compartment of the hopper. The second set of upper shafts are configured to cause movement of loose fill insulation material toward the access opening between the upper and lower conditioning compartments. Desirably, at least a portion of the spikes of the shafts of the second set of upper shafts which extend over the lower conditioning compartment have a flattened end to facilitate movement of loose fill insulation material from the upper conditioning compartment of the hopper into the lower conditioning compartment of the hopper.

A set of lower shafts including at least three shafts is rotatably supported in the lower conditioning compartment of the hopper. The set of lower shafts are supported in the lower conditioning compartment so as to extend longitudinally and in a generally parallel relationship to one another. Thus, a first shaft of the lower set of shafts is vertically spaced above and staggered between a second shaft and a third shaft of the set of lower shafts. Each of the shafts of the lower set of shafts has a plurality of spikes extending radially therefrom, and desirably either the second or the third shaft of the lower set of shafts is adapted to be rotated in a direction opposite the other two shafts of the lower set of shafts.

A drive assembly is operatively connected to the upper and lower shafts such that upon activation of the drive assembly, rotational movement is provided to each of the upper and lower shafts.

An object of the present invention is to provide an apparatus capable of conditioning and dispensing high volumes of loose fill insulation material.

Other objects, features and advantages of the present invention will become apparent from the following detailed description when read in conjunction with the accompanying drawings and appended claims.

DETAILED DESCRIPTION OF THE INVENTION

Figure 1:
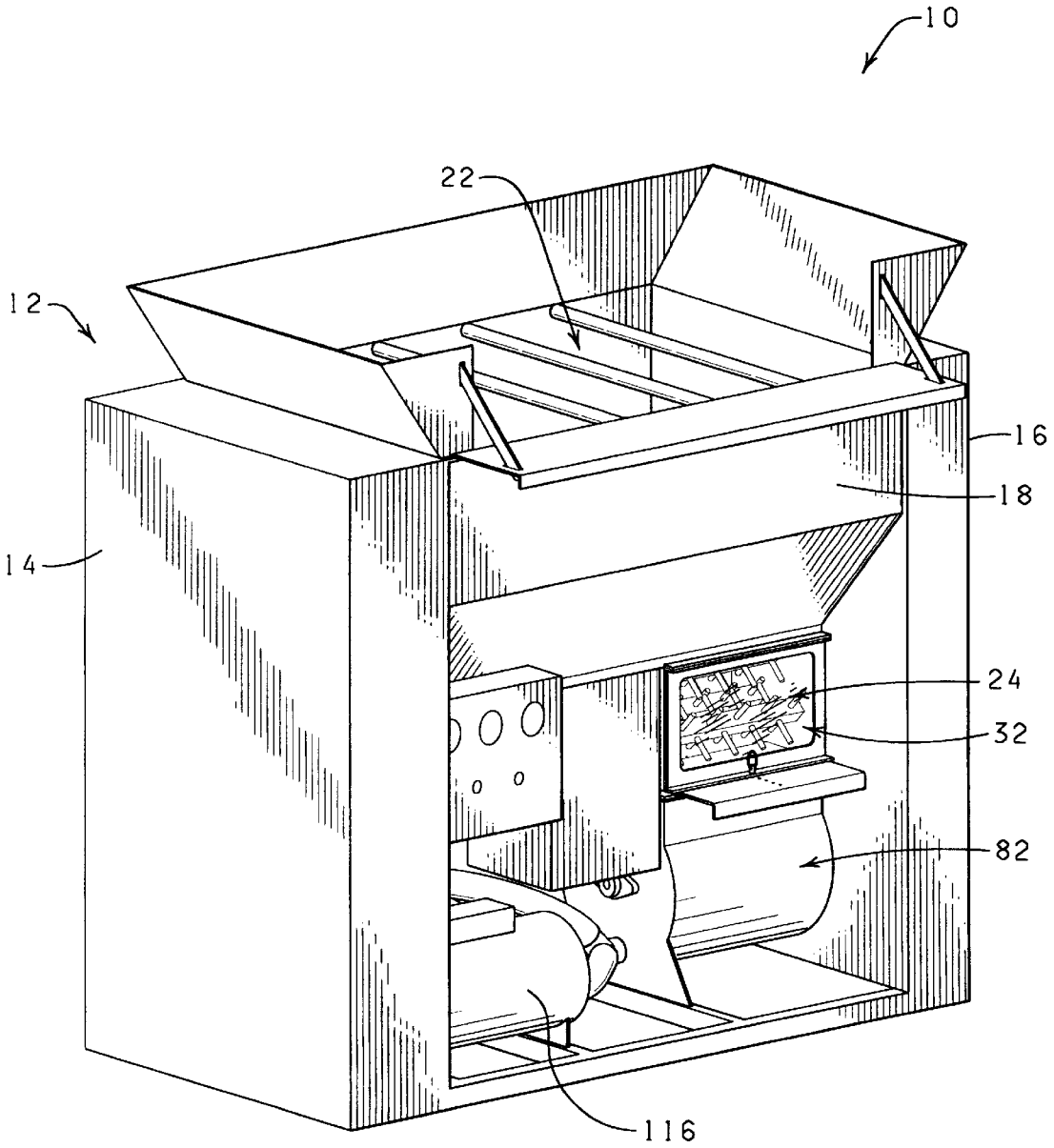
FIG. 1 is a perspective view of an apparatus constructed in accordance with the present invention for conditioning and dispensing loose fill insulation material.
Figure 2:
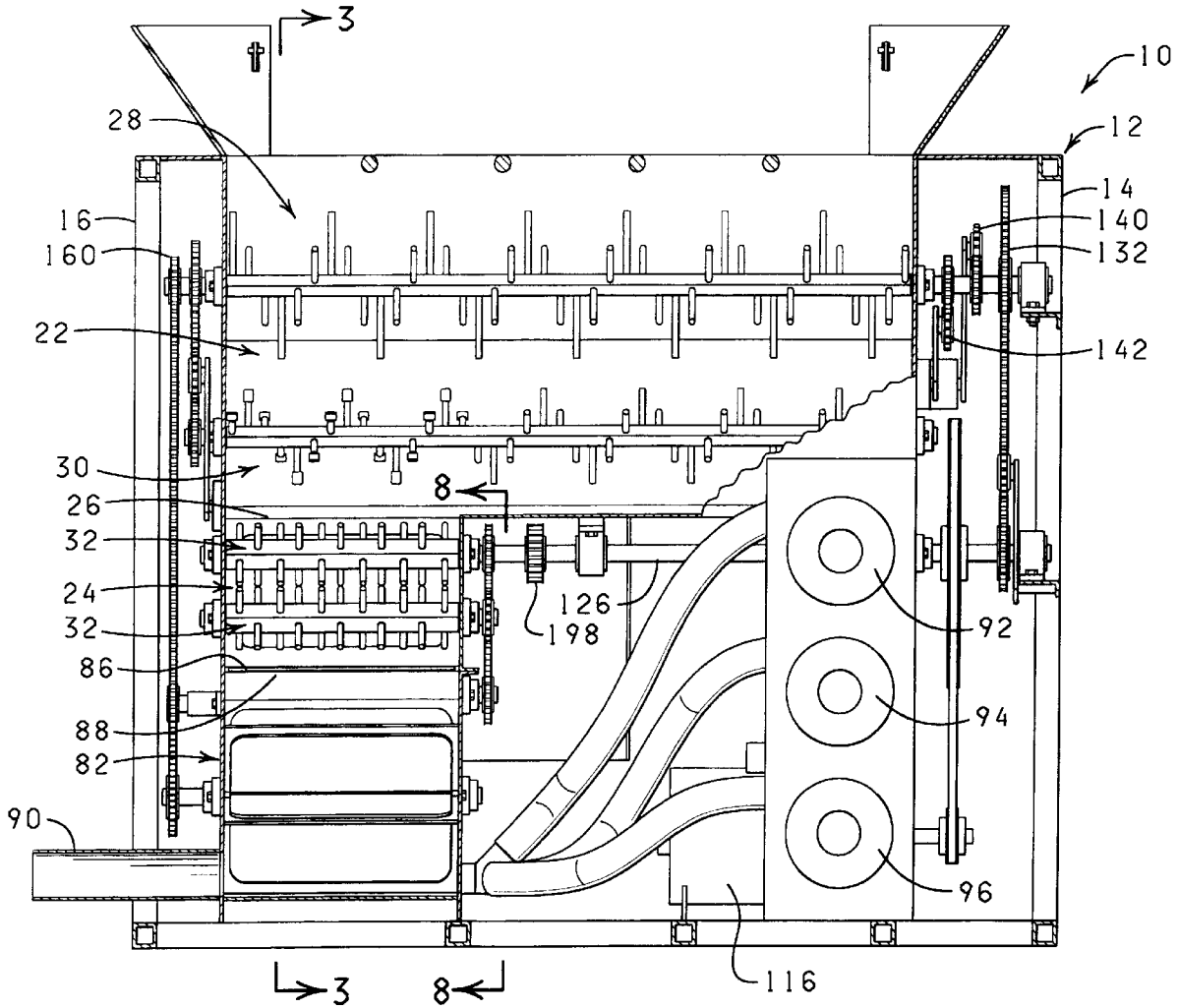
FIG. 2 is a partial cutaway elevational view of a rear side of the apparatus of FIG. 1.
Figure 3:
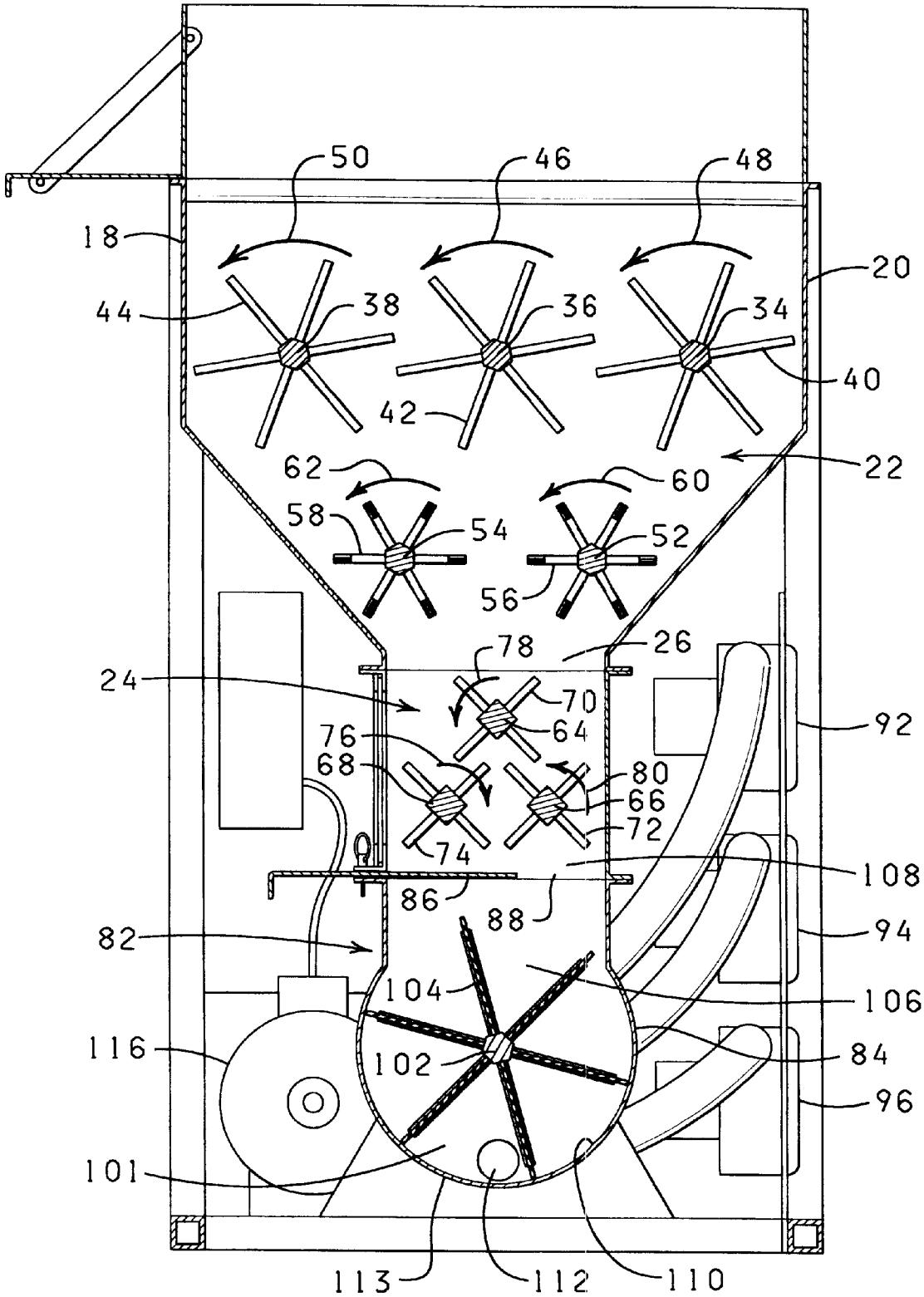
FIG. 3 is a cross sectional view taken along line 3—3 in FIG. 2.

Referring now to the drawings, and more particularly to FIGS. 1, 2 and 3, shown therein is an apparatus 10 for conditioning and dispensing loose fill insulation material constructed in accordance with the present invention. The apparatus 10 is provided with a hopper 12. The hopper 12 has a first end 14, a second end 16, a first side 18, and a second side 20 (shown in FIG. 3), which cooperate to define an upper conditioning compartment 22 and a lower conditioning compartment 24. The upper conditioning compartment 22, which is in open communication with the lower conditioning compartment 24 proximate the second end 16 of the hopper 12 via an access opening 26, extends from the first end 14 of the hopper 12 to the second end 16 of the hopper 12, while the lower conditioning compartment 24 (which extends from the second end 16 of the hopper 12 toward the first end 14 of the hopper 12) has a length less than the length of the upper conditioning compartment 22 substantially, as shown in FIG. 2.

The apparatus 10 further includes a first set of upper shafts 28, a second set of upper shafts 30 and a set of lower shafts 32. The first and second sets of upper shafts 28 and 30 are rotatably supported in the upper conditioning compartment 22 so as to be disposed in a generally parallel relationship, and the set of lower shafts 32 is rotatably supported in the lower conditioning compartment 24 of the hopper 12.

As more closely shown in FIG. 3, the first set of upper shafts 28 includes three shafts 34, 36 and 38 rotatably and longitudinally supported in the upper conditioning compartment 22 of the hopper 12 so as to be disposed in a generally parallel relationship and thereby provide shaft 36 as a centrally disposed shaft and shafts 34 and 38 as outer shafts substantially as shown. Each of the shafts 34, 36 and 38 of the first set of upper shafts 28 has a plurality of spikes 40, 42 and 44, respectively, extending radially therefrom in a helical pattern. The helical pattern of spikes 42 on the shaft 36 of the first set of upper shafts 28 cause movement of loose fill insulation material away from the access opening 26 of the hopper 12 upon rotation of the shaft 36 in a direction 46, while the helical pattern of the spikes 40 and 44 of each of the shafts 34 and 38 of the first set of upper shafts 28 cause movement of loose fill insulation material toward the access opening 26 of the hopper 12 upon rotation of the shaft 34 in a direction 48 and the shaft 38 in a direction 50.

The second set of upper shafts 30 includes two shafts, a shaft 52 and a shaft 54, both rotatably and longitudinally supported in the upper conditioning compartment 22 of the hopper 12 below the first set of upper shafts 28 so as to be disposed in a generally parallel staggered relationship with respect to the shafts 34, 36 and 38 of the first set of upper shafts 28. A portion of the shafts 52 and 54 of the second set of upper shafts 30 is positioned above the lower conditioning compartment 24 of the hopper 12. Each of the shafts 52 and 54 of the second set of upper shafts 30 has a plurality of spikes 56 and 58, respectively, extending radially therefrom in a helical pattern. The helical pattern of spikes 56 shaft 52 of the second set of upper shafts 30 cause movement of loose fill insulation material toward the access opening 26 upon rotation of shaft 52 of the second set of upper shafts 30 in a direction 60, while the spikes 58 of shaft 54 of the second set of upper shafts 30 cause movement of loose fill insulation material away from the access opening 26 upon rotation of the shaft 54 of the second set of upper shafts 30. In addition, a portion of the spikes 56 and 58 of the shafts 52 and 54 of the second set of upper shafts 30 have flattened ends to facilitate movement of loose fill insulation material from the upper conditioning compartment 22 into the lower conditioning compartment 24 via the access opening 26 of the hopper 12.

The set of lower shafts 32 includes three shafts 64, 66 and 68 rotatably and longitudinally supported in the lower conditioning compartment 24 of the hopper 12 so as to be disposed in a generally parallel relationship to one another. That is, shaft 64 is vertically spaced above and staggered between the shaft 66 and the shaft 68 substantially as shown. Each of the shafts 64, 66 and 68 of the set of lower shafts 32 has a plurality of spikes 70, 72 and 74, respectively, extending radially therefrom. Shaft 68 of the set of lower shafts 32 is adapted to be rotated in a direction 76 opposite a direction of rotation 78 of the shaft 64 of the set of lower shafts 32 and a direction of rotation 80 of shaft 66 of the set of lower shafts 32. Thus, shafts 64 and 66 of the set of lower shafts 32 convey loose fill insulation material in one direction, and shaft 68 of the set of lower shafts 32 conveys loose fill insulation material in the opposite direction.

The apparatus 10 further includes an air lock assembly 82. The air lock assembly 82 includes an air lock chamber 84 positioned below the lower conditioning compartment 24 of the hopper 12 so as to receive conditioned loose fill insulation material from the lower conditioning compartment 24 of the hopper 12. The flow of conditioned loose fill insulation material from the lower conditioning compartment 24 of the hopper 12 into the air lock chamber 84 is selectively controlled via a partition 86, which is slidable across an opening 88 between the lower conditioning compartment 24 of the hopper 12 and the air lock chamber 84 of the air lock assembly 82.

The conditioned insulation material is blown through the air lock chamber 84 of the air lock assembly 82 into a hose 90 (FIG. 2) by a set of blowers 92, 94 and 96, whereby loose fill insulation material is discharged from the apparatus 10.

Referring now to FIGS. 3 and 4A–D, the shafts 34, 36, and 38 of the first set of upper shafts 28, the shafts 52 and 54 of the second set of upper shafts 30, and the shafts 64, 66 and 68 of the set of lower shafts 32 will be described in further detail. The spikes 42 of the shaft 36 of the first set of upper shafts 28 (i.e., the center shaft) extend radially from the shaft 36 in a helical pattern which forms a right-handed conveyor. In this way, when the shaft 36 of the first set of upper shafts 28 is rotated towards the first side 18 of the hopper 12, as indicated by the arrow 46 in FIG. 3, insulation material surrounding the shaft 36 is conveyed toward the first side 18 of the hopper 12 and away from the access opening 26. The spikes 42 of the shaft 36 of the first set of upper shafts 28 also condition the loose fill insulation material by cutting through and dispersing the fibers into smaller clumps.

Figure 4A:
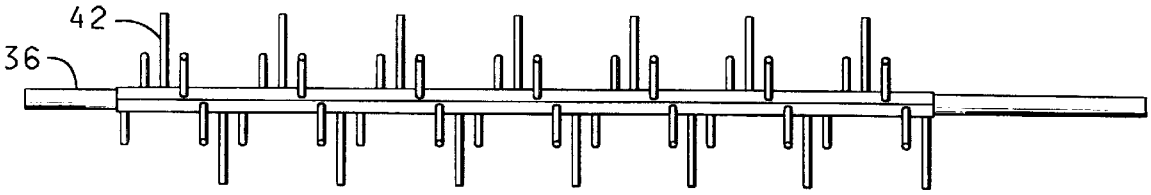
FIG. 4A is a side elevational view of one shaft of a first set of upper shafts.

The spikes 40 of the shaft 34 of the first set of upper shafts 28 (i.e., an outer shaft) extend radially from the shaft 34 in a helical pattern which is identical to the spikes 42 of the shaft 36, which are diagrammatically represented in FIG. 4A. Thus, if the shaft 34 of the first set of upper shafts 28 is rotated towards the first side 18 of the hopper 12, as indicated by the arrow 48 in FIG. 3, insulation material surrounding the shaft 34 will be rolled toward the first side 18 of the hopper 12 and conveyed toward the access opening 26. The spikes 40 also condition the loose fill insulation material by cutting through and dispersing the fibers into smaller clumps.

Figure 4B:
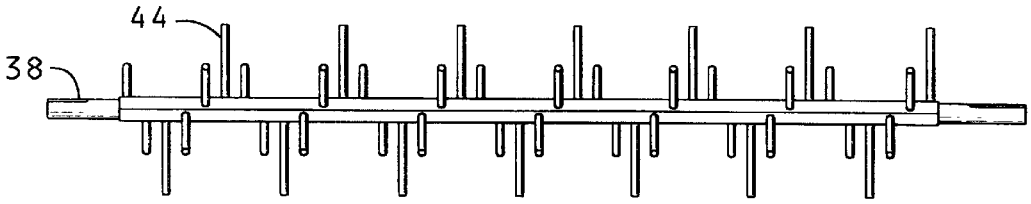
FIG. 4B is a side elevational view of a second shaft of the first set of upper shafts.

The spikes 44 of the shaft 38 of the first set of upper shafts 28 (i.e., an outer shaft) extend radially from the shaft 38 in a helical pattern which forms a left-handed conveyor, which are diagrammatically represented in FIG. 4B. In this way, when the shaft 38 is rotated towards the first side 18 of the hopper 12, as indicated by the arrow 50 in FIG. 3, insulation material surrounding the shaft 38 is conveyed toward the access opening 26. The spikes 44 also condition the loose fill insulation material by cutting through and dispersing the fibers into smaller clumps.

Figure 4C:
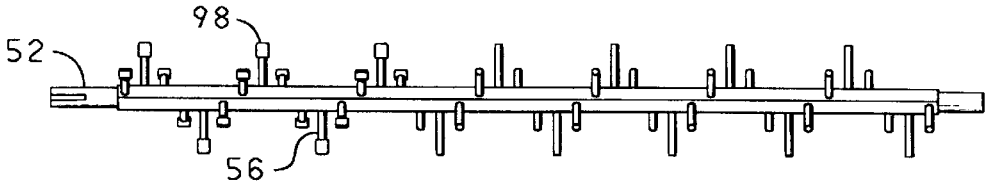
FIG. 4C is a side elevational view of a shaft of a second set of upper shafts.
Figure 4D:
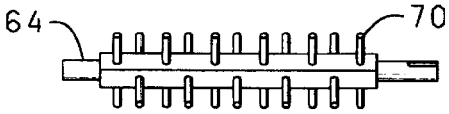
FIG. 4D is a side elevational view of a shaft of a set of lower shafts.

The shafts 52 and 54 of the second set of upper shafts 30 are substantially identical in construct. Thus, only shaft 52, which is shown in FIG. 4C, will be described hereinafter. The spikes 56 of the shaft 52 of the second set of upper shafts 30 extend radially from the shaft 52 in a helical pattern which forms a right-handed conveyor. A portion of the spikes 56 of the shaft 52 of the second set of upper shafts 30 have flattened ends 98 to facilitate movement of loose fill insulation material through the access opening 26 into the lower conditioning compartment 24 of the hopper 12.

Referring again to FIG. 3, when the shaft 52 and the shaft 54 of the second set of upper shafts 30 are rotated toward the first side 18 of the hopper 12, as indicated by the arrows 60 and 62, respectively, insulation material surrounding the shaft 52 of the second set of upper shafts 30 will be conveyed toward the access opening 26, while insulation material surrounding the shaft 54 of the second set of upper shafts 30 will be conveyed away from the access opening 26. This dispersal of the insulation material will prevent clogging at the access opening 26 into the lower conditioning compartment 24 of the hopper 12. The spikes 56 of the shaft 52 of the second set of upper shafts 30 and the spikes 58 of the shaft 54 of the second set of upper shafts 30 also condition the loose fill insulation material by cutting through and dispersing the fibers into smaller clumps.

Figure 5:
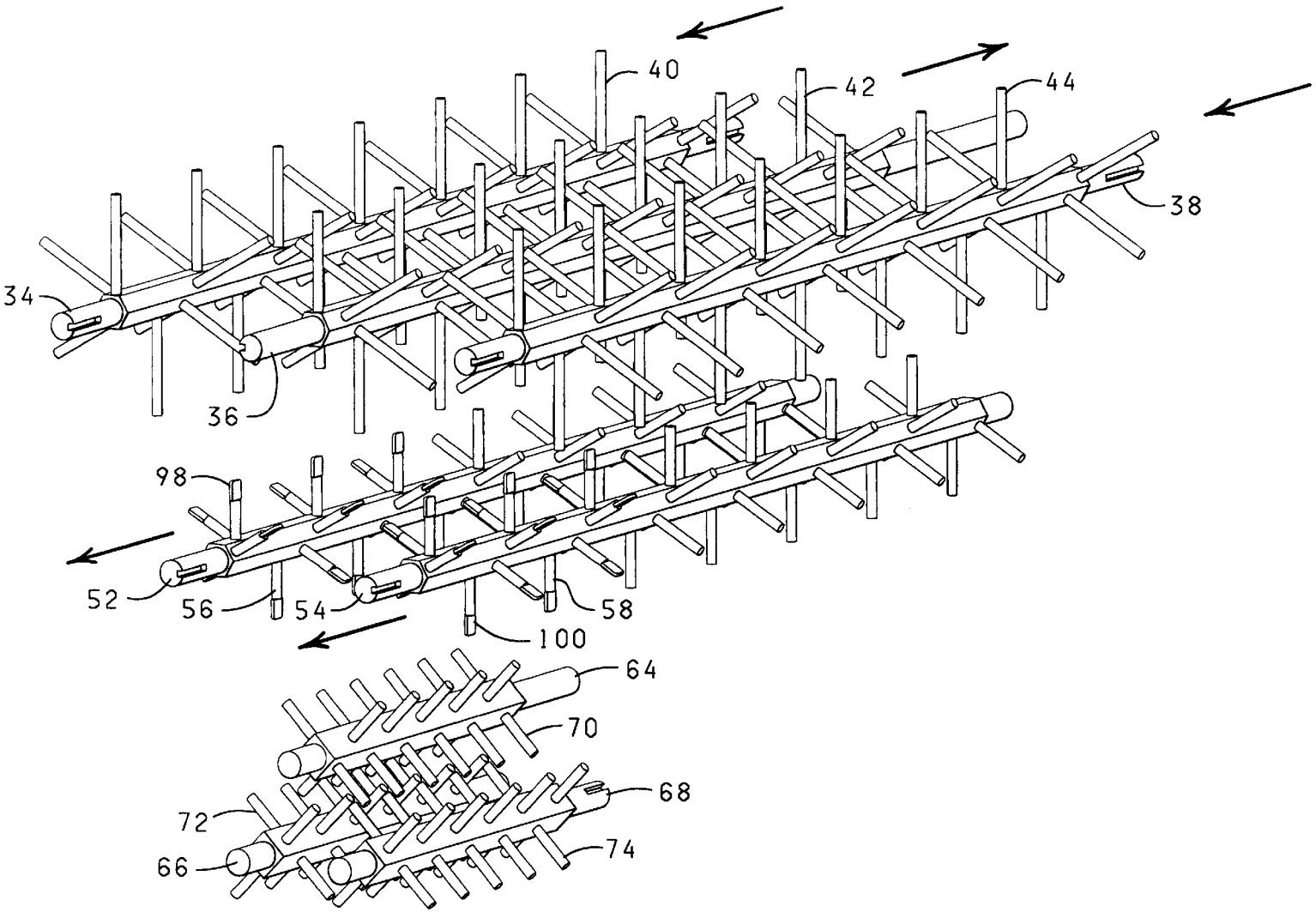
FIG. 5 is a perspective view of the first and second sets of upper shafts and the set of lower shafts of the apparatus with arrows illustrating the flow path of insulation material.

The shafts 34, 36 and 38 of the first set of upper shafts 28, the shafts 52 and 54 of the second set of upper shafts 30, and the shafts 64, 66 and 68 of the set of lower shafts 32, as well as the direction of flow of insulation material, are depicted in FIG. 5. As stated above, the shafts 34 and 36 of the first set of upper shafts 28 convey the loose fill insulation material in a direction opposite to the shaft 38 of the first set of upper shafts 28, while shafts 64 and 66 of the set of lower shafts 32 convey loose fill insulation material in a direction opposite to the shaft 68 of the set of lower shafts 32. This counter-current flow pattern created by the shafts 34, 36 and 38 of the first set of upper shafts 28 and the shafts 64, 66 and 68 of the set of lower shafts 32 churns and agitates the insulation material inside the hopper 12 and thus contributes to the dispersal of the fibers of the loose fill insulation material.

Now it will be understood that in other embodiments contemplated by this invention, the direction of rotation or orientation of the conveyor shafts, or both, may be changed.

As shown in FIG. 3, the air lock chamber 84 of the air lock assembly 82 is supported below the lower conditioning compartment 24 of the hopper 12 and has a substantially circular cross-sectional lower portion 101. A shaft 102 is longitudinally mounted in the substantially circular cross-sectional lower portion 101 of the air lock chamber 84 of the air lock assembly 82. A plurality of blades or vanes 104 extend radially from the shaft 102, and pockets (i.e., a pocket 106 as shown in FIG. 3) are present in the area between two of the blades 104. As the shaft 102 is rotated, amounts of conditioned insulation material are received in each pocket 106 through the opening 88 as the pocket 106 rotates past the opening 88. The slidable partition 86 is supported in a bottom 108 of the lower conditioning compartment 24 of the hopper 12. In this way, the amount of material entering each pocket 106 may be controlled by adjusting the position of the slidable partition 86. As the shaft 102 in the air lock chamber 84 of the air lock assembly 82 rotates, the pocket 106 comes into contact with an inner wall 110 of the air lock chamber 84 of the air lock assembly 82, thus sealing off the pocket 106 containing the conditioned loose fill insulation material. Airflow from the set of three blowers 92, 94 and 96 enters the air lock chamber 84 of the air lock assembly 82 through an opening 112 (FIG. 3) near the bottom 113 of the air lock chamber 84 of the air lock assembly 82 and forces the conditioned loose fill insulation material in the pocket 106 into the hose 90 (FIG. 2) through which it is transported to an applicator device (not shown) in a known manner.

The shafts 34, 36, and 38 of the first set of upper shafts 28, shafts 52 and 54 of the second set of upper shafts 30, shafts 64, 66 and 68 of the set of lower shafts 32, and the shaft 102 of the air lock chamber 84 of the air lock assembly 82 are operatively driven by a drive assembly 114 which includes a motor 116 (FIG. 3) and a series of chains and sprockets. The drive assembly 114 is best shown in FIGS. 6, 7 and 8, to which attention is now directed.

Figure 6:
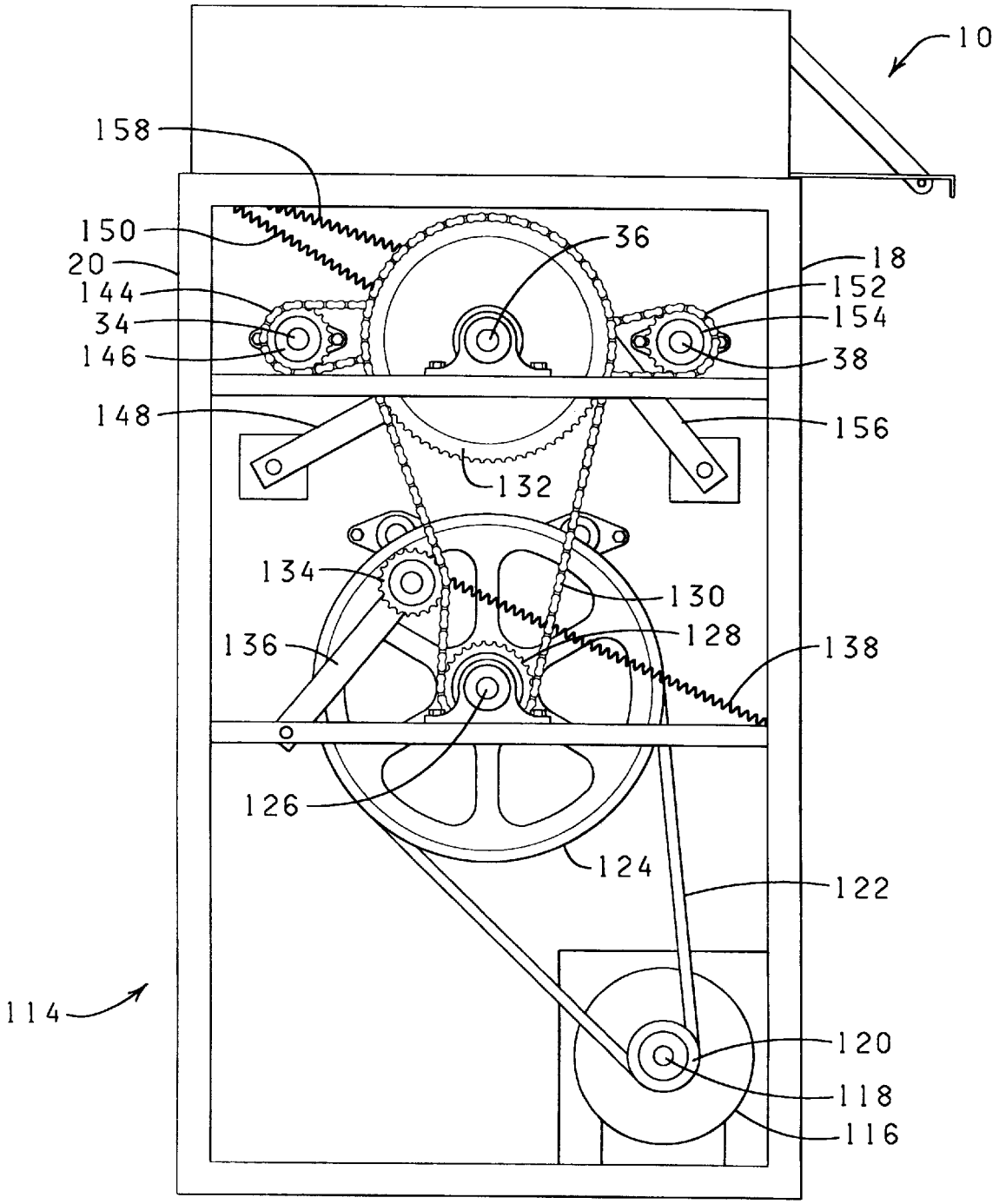
FIG. 6 is an end view of the apparatus of FIG. 1 having a first end of the hopper removed therefrom.

FIG. 6 depicts a portion of the drive assembly 114 located at the first end 14 of the apparatus 10. The motor 116 has a drive shaft 118 which carries a drive pulley 120. The drive pulley 120 drives a belt 122 passing around the pulley 120 and a pulley 124. The pulley 124 is fixed on a drive shaft 126 which drives a sprocket 128, which is also fixed on the drive shaft 126. The sprocket 128 drives a chain 130 passing around a sprocket 132 carried on the shaft 36 of the first set of upper shafts 28. An idler sprocket 134, which is held in contact with the chain 130 by an idler arm 136 and an idler spring 138, maintains the tension of the chain 130 so that power is effectively transmitted from the motor 116 to the pulley 124 and subsequently to the sprocket 132 which drives the shaft 36 of the first set of upper shafts 28.

Two sprockets 140 and 142 (shown in FIG. 2) are fixed to the shaft 36 of the first set of upper shafts 28 interior to the sprocket 132. The sprocket 140 drives a chain 144 passing over a sprocket 146 (FIG. 6) on the shaft 34 of the first set of upper shafts 28, and this rotates the shaft 34 of the first set of upper shafts 28. Tension in the chain 144 is maintained by an idler sprocket (not shown), which is held in contact with the chain 144 by an idler arm 148 and an idler spring 150. In a similar way, the sprocket 142 drives a chain 152 passing over a sprocket 154 (FIG. 6) on the shaft 38 of the first set of upper shafts 28, and thus rotates the shaft 38 of the first set of upper shafts 28. An idler sprocket (not shown) is held in contact with the chain 152 by an idler arm 156 and an idler spring 158 to maintain tension on the chain 152.

Figure 7:
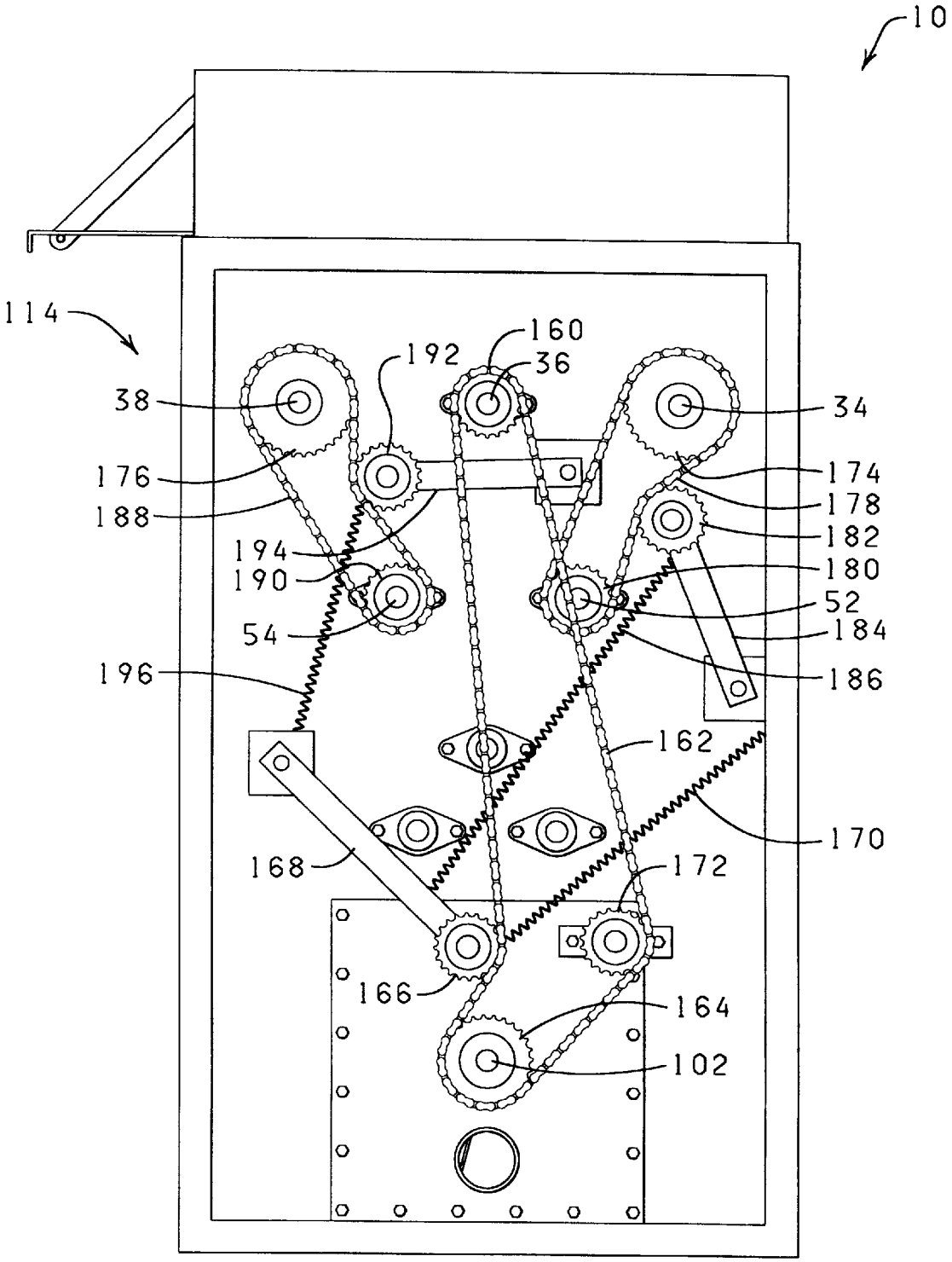
FIG. 7 is an end view of the apparatus of FIG. 1 having a second end of the hopper removed therefrom.
Figure 8:
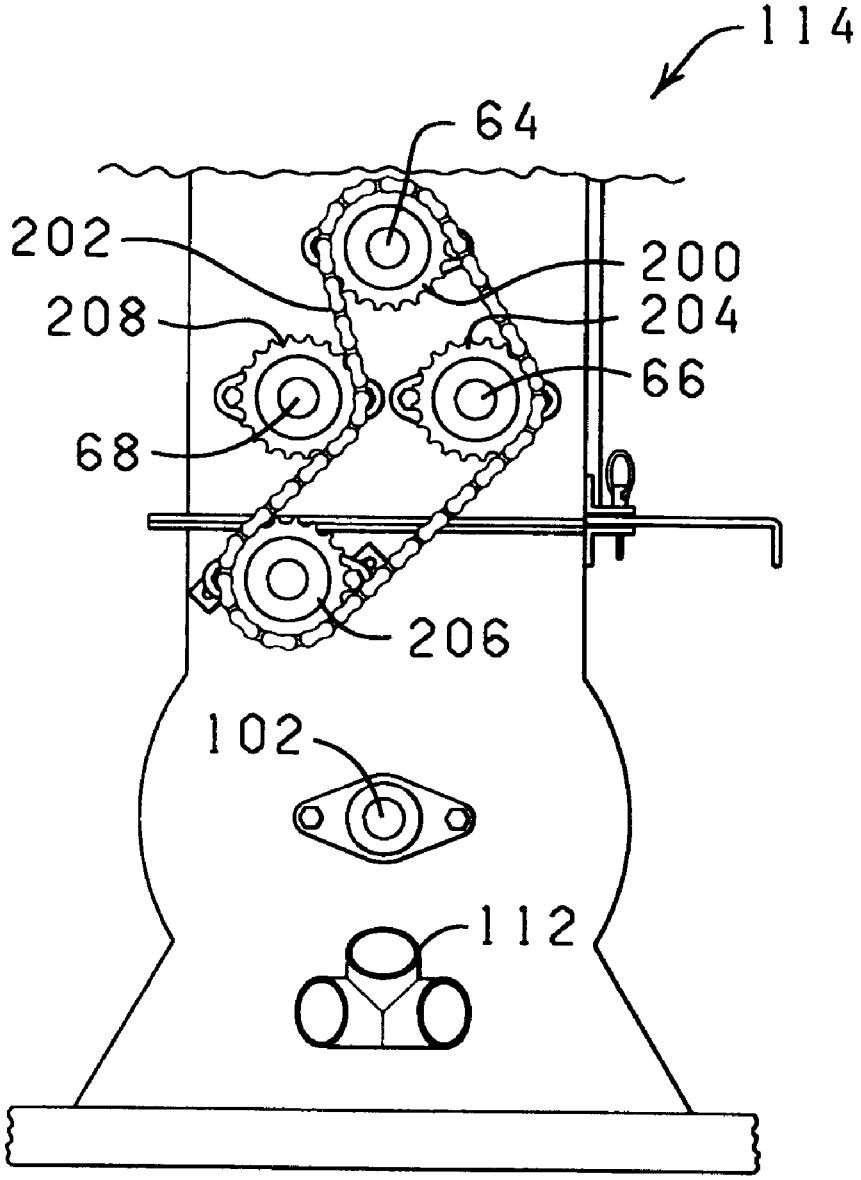
FIG. 8 is a fragmented, cross sectional view taken along line 8—8 in FIG. 2.

As shown in FIGS. 2 and 7, the opposite end of the shaft 36 of the first set of upper shafts 28 carries a sprocket 160 which drives a chain 162. The chain 162 drives a sprocket 164 which is fixed to the shaft 102 of the air lock assembly 82. An idler sprocket 166, which is held in contact with the chain 162 by an idler arm 168 and an idler spring 170, together with an idler sprocket 172 maintain tension so that the power is effectively transmitted from the shaft 36 of the first set of upper shafts 28 to the shaft 102 of the air lock assembly 82 through the sprockets 160 and 164.

The opposite end of each of the shafts 34 and 38 of the first set of upper shafts 28 is provided with a sprocket 174 and a sprocket 176, respectively. The sprocket 174 drives a chain 178 passing over a sprocket 180 fixed on the shaft 52 of the second set of upper shafts 30. An idler sprocket 182, which is held in contact with the chain 178 by an idler arm 184 and an idler spring 186, maintains tension on the chain 178. The sprocket 176 drives a chain 188 passing over a sprocket 190 fixed on the shaft 54 of the second set of upper shafts 30. An idler sprocket 192, which is held in contact with the chain 188 by an idler arm 194 and an idler spring 196, maintains tension on the chain 188.

Referring now to FIGS. 2 and 8, the drive shaft 126 is coupled to the shaft 64 of the set of lower shafts 32 by a coupling 198 (FIG. 2). The shaft 64 of the set of lower shafts 32 has a sprocket 200 which drives a chain 202 passing over a sprocket 204 which is carried on the shaft 66 of the set of lower shafts 32, over an idler sprocket 206, and under a sprocket 208, which is carried on the shaft 68 of the set of lower shafts 32, such that power is transmitted from the drive shaft 126 to all three shafts 64, 66 and 68 of the set of lower shafts 32, with the shafts 64 and 66 of the set of lower shafts 32 rotated in one direction while the shaft 68 of the set of lower shafts 32 is rotated in the opposite direction.

The size and type of motor 116, as well as the size of the various chains and sprockets, are selected to provide a desired rotation rate. Furthermore, the speed of rotation may be determined in part by the pitch of the conveyors. The motor 116, the various sprockets and chains should be selected accordingly. In most instances a 2 horsepower motor which operates on 220/240 household current will be sufficient.

An advantage of the present invention is that the same structures which convey the insulation material from the hopper 12 also condition the material. This simplifies the construction and operation of the machine. Another advantage of this invention is the improved conditioning made possible by the multi-directional conveyor shafts and the counter-current flow pattern produced by them, and in turn, the increased speed at which the material can be processed through the apparatus 10. For example, machines constructed in accordance with this invention can process approximately 175 to 180 25-pound bags of cellulosic insulation per hour.

From the above description, it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. An apparatus for conditioning and dispensing loose fill insulation material, comprising:

a hopper having a first end, a second end, a first side, and a second side, the hopper defining an upper conditioning compartment and a lower conditioning compartment, the upper conditioning compartment having a length extending from the first end of the hopper to the second end of the hopper and the lower conditioning compartment having a length less than the length of the upper conditioning compartment, the lower conditioning compartment being in open communication with the upper compartment proximate one end of the hopper via an access opening;

a first set of upper shafts including at least three shafts rotatably and longitudinally supported in the upper conditioning compartment of the hopper in a generally parallel, horizontal planar relationship so as to provide a center shaft and two outer shafts, each of the upper shafts having a plurality of spikes extending radially therefrom in a helical pattern, the helical pattern of the center shaft configured to cause movement of loose fill insulation material away from the access opening of the hopper upon rotation of the center shaft and the helical pattern of each of the outer shafts configured to cause movement of loose fill insulation material toward the access opening upon rotation of the outer shafts;

a second set of upper shafts including a pair of shafts rotatably and longitudinally supported in the upper conditioning compartment of the hopper below the first set of upper shafts in a generally parallel, staggered relationship with respect to the shafts of the first set of upper shafts and with a portion of the shafts of the second set of upper shafts positioned above the lower conditioning compartment, each of the shafts of the second set of upper shafts having a plurality of spikes extending radially therefrom in a helical pattern which causes movement of loose fill insulation material toward the access opening upon rotation of the shafts of the second set of upper shafts;

a set of lower shafts including at least three shafts rotatably and longitudinally supported in the lower conditioning compartment of the hopper in a generally parallel relationship to one another so as to provide a first shaft vertically spaced above and staggered between a second shaft and a third shaft, the first, second, and third shafts each having a plurality of spikes extending radially therefrom;

drive means for rotating each of the upper and lower shafts;

an air lock positioned below the lower conditioning compartment for receiving the conditioned loose fill insulation material from the lower conditioning compartment; and means for discharging the conditioned loose fill insulation material from the air lock.

2. The apparatus of claim 1 wherein a portion of the spikes of the shafts of the second set of upper shafts extend over the lower conditioning compartment have a flattened end to facilitate movement of loose fill insulation material from the upper conditioning compartment into the lower conditioning compartment.

3. The apparatus of claim 1 wherein one of the second and third lower shafts is adapted to be rotated in a direction opposite the other two lower shafts.

4. The apparatus of claim 1 further comprising:

a slidable partition supported in the bottom of the lower conditioning compartment to provide an adjustable opening whereby the flow of conditioned loose fill insulation material from the lower conditioning compartment into the air lock may be selectively controlled.

5. An apparatus for conditioning and dispensing loose fill insulation material, comprising:

a hopper having a first end, a second end, a first side, and a second side, the hopper defining an upper conditioning compartment and a lower conditioning compartment, the upper conditioning compartment having a length extending from the first end of the hopper to the second end of the hopper, the lower conditioning compartment having a length less than the length of the upper conditioning compartment and the lower conditioning compartment being in open communication with the upper compartment proximate one end of the hopper via an access opening;

at least one upper shaft rotatably and longitudinally supported in the upper conditioning compartment of the hopper, the shaft having a plurality of spikes extending radially therefrom in a helical pattern, the helical pattern of the shaft configured to cause movement of loose fill insulation material toward the access opening;

at least three lower shafts rotatably and longitudinally supported in the lower conditioning compartment of the hopper in a generally parallel relationship to one another so as to provide a first lower shaft vertically spaced above and staggered between a second lower shaft and a third lower shaft, the first, second, and third lower shafts each having a plurality of spikes extending radially therefrom and one of the second and third lower shafts adapted to be rotated in a direction opposite the other two lower shafts;

drive means for rotating each of the upper and lower shafts;

an air lock positioned below the lower conditioning compartment for receiving the conditioned loose fill insulation material from the lower conditioning compartment; and means for discharging the conditioned loose fill insulation material from the air lock.

6. The apparatus of claim 5 wherein a portion of the spikes of the upper shaft extend over the lower conditioning compartment, and wherein the spikes of the upper shaft extending over the lower conditioning compartment have a flattened end to facilitate movement of loose fill insulation material from the upper conditioning compartment into the lower conditioning compartment.

7. The apparatus of claim 5 further comprising:

a slidable partition supported in the bottom of the lower conditioning compartment to provide an adjustable opening whereby the flow of conditioned loose fill insulation material from the lower conditioning compartment into the air lock may be selectively controlled.

8. An apparatus for conditioning and dispensing loose fill insulation material, comprising:

a hopper having a first end, a second end, a first side, and a second side, the hopper defining an upper conditioning compartment and a lower conditioning compartment, the upper conditioning compartment having a length extending from the first end of the hopper to the second end of the hopper, the lower conditioning compartment having a length less than the length of the upper conditioning compartment and the lower conditioning compartment being in open communication with the upper compartment proximate one end of the hopper via an access opening;

at least two upper shafts rotatably and longitudinally supported in the upper conditioning compartment of the hopper, one of the upper shafts having a plurality of spikes extending radially therefrom in a helical pattern, configured to cause movement of loose fill insulation material away from the access opening and one of the upper shafts having a plurality of spikes extending radially therefrom in a helical pattern configured to cause movement of loose fill insulation material toward the access opening;

at least three lower shafts rotatably and longitudinally supported in the lower conditioning compartment of the hopper in a generally parallel relationship to one another so as to provide a first lower shaft vertically spaced above and staggered between a second lower shaft and a third lower shaft, the first, second, and third lower shafts each having a plurality of spikes extending radially therefrom and one of the second and third lower shafts adapted to be rotated in a direction opposite the other two lower shafts;

drive means for rotating each of the upper and lower shafts;

an air lock positioned below the lower conditioning compartment for receiving the conditioned loose fill insulation material from the lower conditioning compartment; and means for discharging the conditioned loose fill insulation material from the air lock.

9. The apparatus of claim 8 wherein a portion of the spikes of at least one of the upper shafts extend over the lower conditioning compartment, and wherein the spikes of the upper shaft extending over the lower conditioning compartment have a flattened end to facilitate movement of loose fill insulation material from the upper conditioning compartment into the lower conditioning compartment.

10. The apparatus of claim 8 further comprising:

a slidable partition supported in the bottom of the lower conditioning compartment to provide an adjustable opening whereby the flow of conditioned loose fill insulation material from the lower conditioning compartment into the air lock may be selectively controlled.

11. An apparatus for conditioning and dispensing loose fill insulation material, comprising:

a hopper having a first end, a second end, a first side, and a second side, the hopper defining an upper conditioning compartment and a lower conditioning compartment, the upper conditioning compartment having a length extending from the first end of the hopper to the second end of the hopper, the lower conditioning compartment having a length less than the length of the upper conditioning compartment and the lower conditioning compartment being in open communication with the upper compartment proximate one end of the hopper via an access opening;

a first set of upper shafts including at least three shafts rotatably and longitudinally supported in the upper conditioning compartment of the hopper in a generally parallel, horizontal planar relationship so as to provide a center shaft and two outer shafts, each of the upper shafts having a plurality of spikes extending radially therefrom in a helical pattern, the helical pattern of the center shaft configured to cause movement of loose fill insulation material away from the access opening of the hopper upon rotation of the center shaft and the helical pattern of each of the outer shafts configured to cause movement of loose fill insulation material toward the access opening upon rotation of the outer shafts;

a second set of upper shafts including a pair of shafts rotatably and longitudinally supported in the upper conditioning compartment of the hopper below the first set of upper shafts in a generally parallel, staggered relationship with respect to the shafts of the first set of upper shafts and with a portion of the shafts of the second set of upper shafts positioned above the lower conditioning compartment, each of the shafts of the second set of upper shafts having a plurality of spikes extending radially therefrom in a helical pattern which causes movement of loose fill insulation material toward the access opening upon rotation of the shafts of the second set of upper shafts, the spikes of the shafts of the second set of upper shafts having a flattened end to facilitate movement of loose fill insulation material from the upper conditioning compartment into the lower conditioning compartment;

a set of lower shafts including at least three shafts rotatably and longitudinally supported in the lower conditioning compartment of the hopper in a generally parallel relationship to one another so as to provide a first shaft vertically spaced above and staggered between a second shaft and a third shaft, the first, second, and third shafts each having a plurality of spikes extending radially therefrom and one of the second and third lower shafts adapted to be rotated in a direction opposite the other two lower shafts;

drive means for rotating each of the upper and lower shafts;

an air lock positioned below the lower conditioning compartment for receiving the conditioned loose fill insulation material from the lower conditioning compartment;

a slidable partition supported in the bottom of the lower conditioning compartment to provide an adjustable opening whereby the flow of conditioned loose fill insulation material from the lower conditioning compartment into the air lock may be selectively controlled; and means for discharging the conditioned loose fill insulation material from the air lock.

* * * * *

UNITED STATES PATENT AND TRADEMARK OFFICE

CERTIFICATE OF CORRECTION

PATENT NO. : 6,109,488
DATED : August 29, 2000
INVENTOR(S) : Paul H. Horton

It is certified that error appears in the above-identified patent and that said Letters Patent is hereby corrected as shown below:

Column 2,
Line 29, delete "have" and substitute therefor -- has --.
Line 47, delete "are" and substitute therefor "is".
Line 52, delete "have" and substitute therefor "has".
Line 58, delete "are" and substitute therefor -- is --.

Column 4,
Line 13, delete "cause" and substitute therefor -- causes --.
Line 17, delete "cause" and substitute therefor -- causes --.
Line 32, delete "shaft 52" and substitute therefor -- of the shaft 52 --.
Line 33, delete "cause" and substitute therefor -- causes --.
Line 39, delete "of the second set of upper shafts 30" and substitute therefor -- in a direction 62 --
Line 40, delete "a portion" and substitiute therefor -- portions --.

Column 5,
Line 50, delete "construct" and substitute therefor -- construction --.
Line 54, delete "A portion" and substitute therefor -- Portions --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*